US005135148A

United States Patent [19]

Wilson, III

[11] Patent Number: 5,135,148

[45] Date of Patent: Aug. 4, 1992

[54] FORMS FEED TRACTOR FOR A PRINTER

[75] Inventor: Joseph T. Wilson, III, Endicott, N.Y.

[73] Assignee: International Business Machines Corporation, Armonk, N.Y.

[21] Appl. No.: 303,707

[22] Filed: Jan. 27, 1989

[51] Int. Cl.[5] ..... B65H 20/20

[52] U.S. Cl. ..... 226/74; 400/616.1

[58] Field of Search ..... 226/74, 75; 400/616.1, 400/616.2; 474/117, 138

[56] References Cited

U.S. PATENT DOCUMENTS

| | | | |
|---|---|---|---|
| 4,226,353 | 10/1980 | Blaskovic et al. | 226/74 |
| 4,421,261 | 12/1983 | Hubbard | 226/74 |
| 4,765,523 | 8/1988 | Ferguson | 400/616.2 X |
| 4,790,467 | 12/1988 | Rex et al. | 226/76 X |
| 4,805,822 | 2/1989 | Milano, Jr. | 226/74 |

*Primary Examiner*—Daniel P. Stodola
*Assistant Examiner*—Paul T. Bowen
*Attorney, Agent, or Firm*—John S. Gasper

[57] ABSTRACT

A tractor mechanism has an endless pin belt entrained around spaced drive and idler sprockets mounted between a pair of frame members. The idler sprocket is supported by a carrier movable longitudinally by springs to apply tension to the belt. The edges of the belt overhang gear teeth of the belt and are prevented from contact with the frame members by the gear teeth engaging an endless vertical wall on one of the frame members. The frame members and sprocket carrier are molded polycarbonate with carbon fiber and solid lubricant fillers to reduce electrostatic charge buildup and wear of the belt. The frame members are bolted together to clamp the sprocket carrier in place to maintain the belt tension applied by the springs. The sprocket carrier and frame members have aligned elongate openings for receiving a tractor guide shaft with a concentric plastic tube, the latter being attached to a retainer plate held loosely between the sprocket carrier and a frame member.

26 Claims, 7 Drawing Sheets

FORMS FEED TRACTOR FOR A PRINTER

FIELD OF THE INVENTION

This invention relates to feed mechanisms and particularly to a tractor feed mechanism used in printers for the incremental feeding of a continuous paper print medium commonly referred to as a web or print forms.

BACKGROUND OF THE INVENTION

A typical paper feed mechanism has an endless, flexible and relatively inextensible sprocket driven belt. The belt has a row of uniformly spaced feed pins extending perpendicularly relative to the outer surface of the belt. The belt has drive teeth around its inside surface and is entrained around to form trace regions between a pair of spaced drive members, such as sprockets, with grooves that mesh with the drive teeth. The paper has one or more rows of uniformly spaced perforations and is driven by the feed belt whose pins are aligned with the row of perforations and have the same spacing so as to enter the perforations near one end of the trace and withdraw from perforations at the other end of the trace. The belt and the length of the trace regions are designed so that several pins simultaneously engage the perforations and drive the paper within the perforations. The sprocket and drive belt assembly are supported between a pair of frame members into which the sprockets are journaled. In some tractors, the drive mechanism comprises a single sprocket and a shoe around which the belt is wound, the shoe being essentially non-rotatable. One problem with the shoe structure is that it is stationary and thereby imposes increased frictional loads and wear on the belt as it slides over the shoe.

The belt is supported in the trace regions between the sprockets by a support structure attached to or made part of one or both of the side frames. The support structure has a horizontal support surface which engages and supports the underside of the flexible belt over at least that portion of the trace distance where several of the feed pins will be within the perforations and in full drive engagement with the paper. The support surface may be a continuous curve or may have a flat portion between upward and downward linear ramps. The gear teeth ride on the support surface. It is common to provide the horizontal support surface with a longitudinal guide slot or channel in which either the gear teeth on the underside of the belt or both gear teeth and belt can enter and be guided by the side walls of the channel. The purpose of the channel is to limit the lateral movement of the belt in the trace region in order that belt and hence the feed pins are maintained in alignment with the perforations in the paper during entry, withdrawal and full engagement with the paper. A problem with previous tractor designs made of plastic was that friction between the guide structure and the belt caused excess loading and wear of the belt thereby causing misalignment of the pins with the perforations of the paper.

High speed printers use as many as four tractors supported on parallel guide and drive shafts of a carriage mechanism. The tractors are movable transversely on the guide shafts to obtain proper alignment of the feed pins with the perforations along the edges of the paper. The adjustment mechanism may comprise lead screws or cables connected to the tractors in a manner whereby all or some of the tractors can be moved laterally along the shafts. In the past, tractor designs were such that many different parts were needed for the different tractors.

Originally tractors were made largely from metal parts to assure long wear and precision required for the feed pins to be aligned with and to enter and withdraw from the perforations without damage to the paper. Such tractors tended to be costly and required a large number of different parts especially to provide tractors for feeding along both edges of the forms. Later tractors were made with parts made almost entirely with plastic materials which could be fabricated by casting or molding processes. The belt was also made entirely of plastic materials molded entirely as a single endless belt or alternatively from a thin strip of plastic or metal with plastic drive elements molded thereto. Examples of such tractors using various plastic materials are shown in U.S. Pat. Nos. 3,825,162; 3,930,601; 4,226,353; 4,457,463 and 4,614,287.

Some of the problems associated with plastic tractors have been lack of adequate structural strength, dimensional instability and rapid wear which affect proper alignment of the belt with the paper and the pins with the perforations. Another problem has been the build up of electrical charge which makes the paper cling to the forms path and resist refolding.

It has been common practice to apply a tensioning force to the belt to maintain a taut pin belt during assembly and operation. Such use has been primarily in tractors where the belt is wrapped around one sprocket and a guide shoe. The guide shoe is mounted between two frame plates so as to be movable therebetween relative to the drive sprocket which is journaled to the frame plates. A compression spring applies pressure to the movable shoe within the space between the sides of the frame members. It is common to lock the shoe in place after the belt has been stretched taut by the spring. As a result of wear through use, the belt eventually develops some slack thereby causing misalignment of the pins and loss of paper control. The shoe is then unlocked so as to allow movement of the shoe relative to the sprocket to thereby restore the necessary amount of tautness to the belt. A problem with prior belt tensioning structures is the tendency of the tensioner to become jammed against the frame members so that when released it will not move solely under the force of the spring to restore the belt to its initial tautness. One reason for this is the lack of adequate space for the tensioner within the tractor. Another is paper dust lodging within the spaces occupied by the tensioner. Yet another is that the materials used tend to change shape or size thereby causing adherence to the frame elements. Some kind of manual operation is then required to unfreeze the shoe from the frame members. Examples of tractor belt tensioning devices are shown in U.S. Pat. Nos. 3,930,601; 4,226,353; 4,453,660; 4,457,463; 4,462,531; 4,638,935 and 4,723,697 and in articles published in the IBM Technical Disclosure Bulletin, Vol. 16 No. 1, Jun. 1973, p. 309; and Vol. 22 No. 7, Dec. 1979, pp. 2636–2637.

SUMMARY OF THE INVENTION

It is the object of this invention to provide a tractor feed mechanisms made mostly of plastic parts which overcomes or minimizes all of the above mentioned problems.

Basically the invention achieves this by providing an improved two part frame structure for supporting and guiding the feed belt and for supporting the drive mechanism that moves the belt. The belt has a tension member with gear teeth and feed pins projecting from opposite surfaces of the tension member. The belt is entrained around a pair of spaced sprockets one of which is journaled to the frame members and the other of which is journaled to a carrier movably supported by the frame members. The frame members are structured and assembled to form a slot for the belt with paper guide surfaces on either side of the belt. The tension member of the belt has borders between the edges of the gear teeth and the edges of the tension member. Friction is minimized by supporting the belt solely along its borders in the trace regions between the sprockets, by the sprockets where the belt wraps around them and by engaging only the edges of the gear teeth to provide lateral guidance. Ledges having a horizontal support surface and a vertical end wall are formed on the tractor frame members for that purpose. The borders of the belt slide on the horizontal surfaces of the ledges in the trace regions of the belt. The horizontal surfaces are made wider than the borders of the belt thereby preventing the edges of the belt from making contact with the frame members. A portion of the horizontal ledge surfaces between the sprockets is coplanar with the paper guide surfaces. The belt makes no engagement with the ledges where the belt wraps around the sprockets. Vertical support to the belt during wrap around comes exclusively from the sprockets. Lateral guidance for the belt both in the trace regions and during wraparound comes solely from the vertical end walls of the ledges engaging the edges of the gear teeth in the trace regions between the sprockets. The vertical end walls of the ledges form a channel in which the gear teeth travel. The spacing between the end walls is greater than the width of the gear teeth so that only one edge of the gear teeth slides against an end wall. As a result of the fact that there is no sliding contact of the bottom of the gear teeth or the edges of the belt for vertical and lateral guidance, the loading on the belt is more uniform and damage to the belt edges and wear are greatly reduced.

The movable sprocket carrier frame is supported between the frame members within an enclosure formed by guide plates extending from the frame members and a cross wall connected between the guide plates. Alignment of the carrier frame and the sprocket is maintained by guide ribs formed on the guide plates which ribs engage the edges of the carrier frame. Friction is reduced by spacing and dimensioning the guide surfaces of the ribs where they engage surfaces of the carrier frame.

The carrier frame has a central web with an elongate opening that aligns with corresponding elongate openings in the frame members of the tractor to form a passageway for the guide shaft on which the tractor is mounted. A guide tube through the elongated openings surrounds the guide shaft. Retention means in the form of a plate extending from the periphery of the tube is held between the frame members so that the guide tube and tractor move together along the guide shaft. The retention plate and the carrier frame are structured to allow the tube to move lengthwise relative to the carrier frame, which is clamped between the frame members, so as to accommodate tolerance variations in spacing between the drive and guide shafts on which the tractor feed mechanism is supported.

In accordance with this invention a tractor feed mechanism in which various the parts, including the frame members, the sprockets and the carrier frame are made from polycarbonate having carbon fiber fillers. Such material provides structural strength and is also beneficial in preventing the accumulation of electrostatic charge on the paper which prevents easy refolding of the paper. Friction is further reduced by adding polytetraflouroethylene to the carbon fiber filled polycarbonate. Nylon filled with carbon fiber and polytetraflouroethylene is used for the sprockets.

DESCRIPTION OF THE PREFERRED EMBODIMENTS

Figure 1:
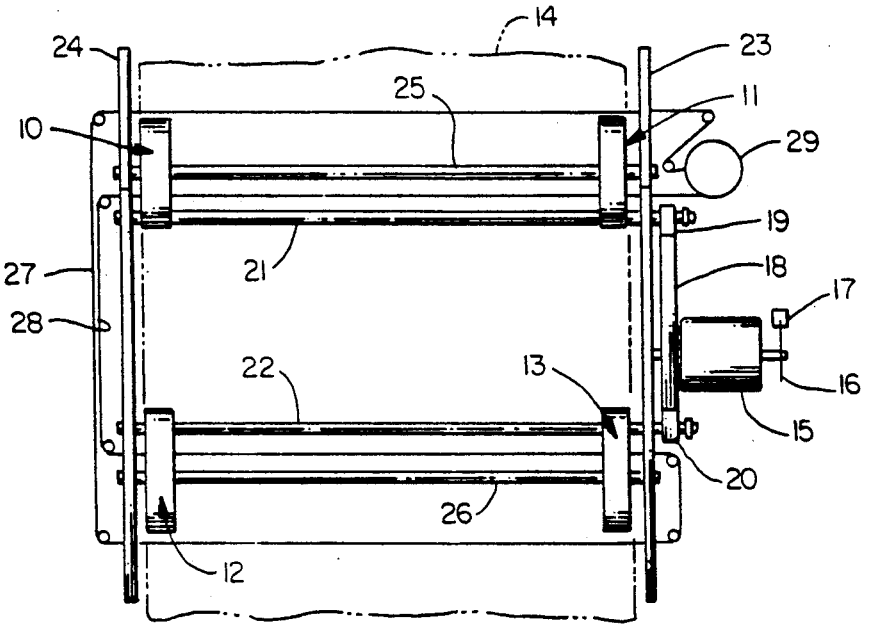
FIG. 1 is a plan view of a schematic of a forms feeding system for a printer using four tractors for feeding paper.

FIG. 1 is a front view of a forms carriage in a printer. Four forms tractors 10–13 increment the print forms 14 (shown by broken lines) by engaging perforations known as feed holes (not shown) at both edges of the forms. As is well known, the feed holes are uniformly spaced to be engaged by similarly spaced feed pins which are part of a feed belt of each of the tractors 10–13 to be described more completely hereinafter.

Tractors 10–13 are driven by a motor 15 which is operated under feedback control from signals produced by and emitter 16 and transducer 17. Motor motion is transmitted to the feed belts of the tractors 10–13 through a timing belt 18 that engages toothed pulleys 19 and 20 on each end of two splined drive shafts 21 and 22 that drive the feed belts of the tractors. Pulleys 19 and 20 are clamped to the drive shafts 21 and 22. Drive shafts 21 and 22 are supported at each end by bearings (not shown) in side plates 23 and 24. Guide shafts 25 and 26, also supported by side plates 23 and 24, as will be seen hereinafter, prevent the tractors 10–13 from rotating about the drive shafts 21 and 22. Tractors 10–13 are slidable on drive shafts 21 and 22 and guide shafts 25 and 26.

A cable system comprising cables 27 and 28 and adjustment knob 29 moves tractors 10–13 along drive shafts 21 and 22 and guide shafts 25 and 26. The cable system is designed to move the right pair of tractors 11 and 13 with respect to the left pair 10 and 12 to accommodate forms of various widths or to move all four tractors together to align the forms with the print columns of the printer. Further details of the cable system may be obtained by reference to an article published in the IBM Technical Disclosure Bulletin, Vol. 29 No. 12, May 1987 at pages 5518 and 5519.

Figure 2:
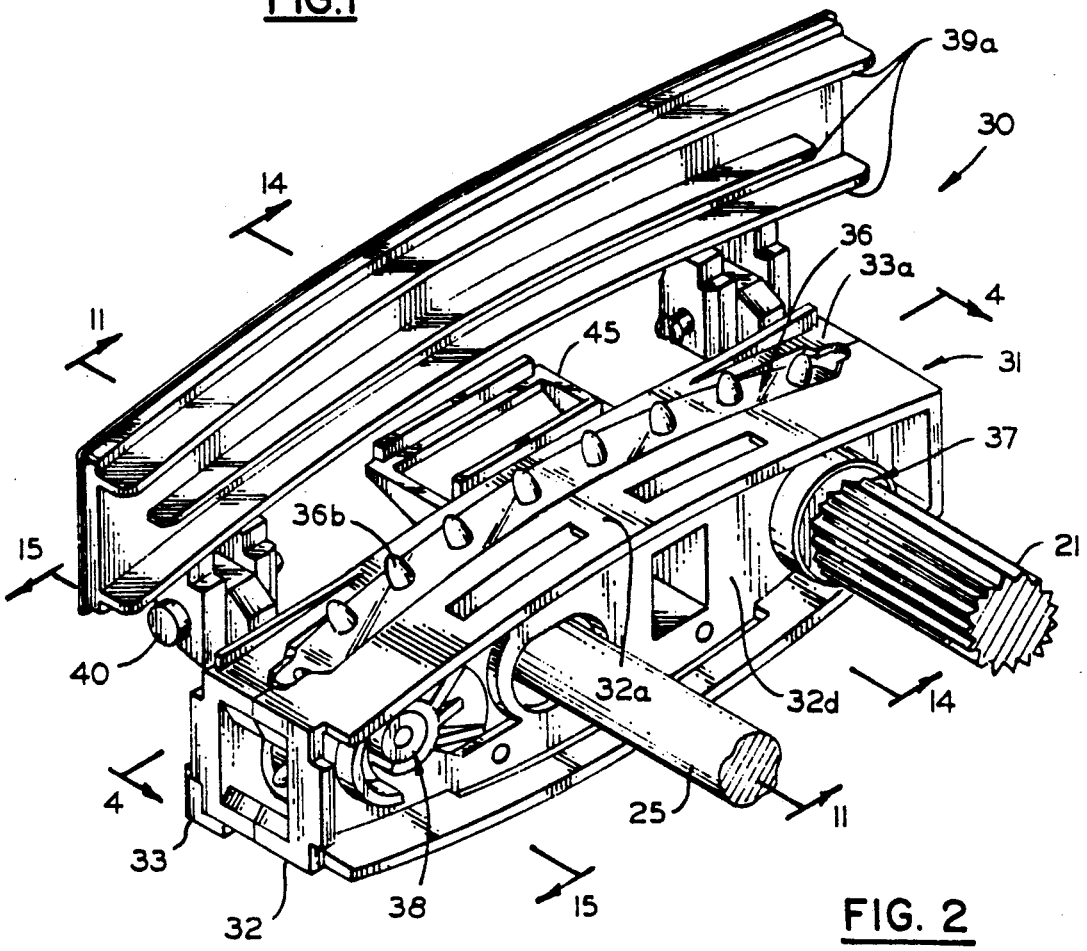
FIG. 2 is a three dimensional view of a tractor assembly for using the invention.
Figure 3:
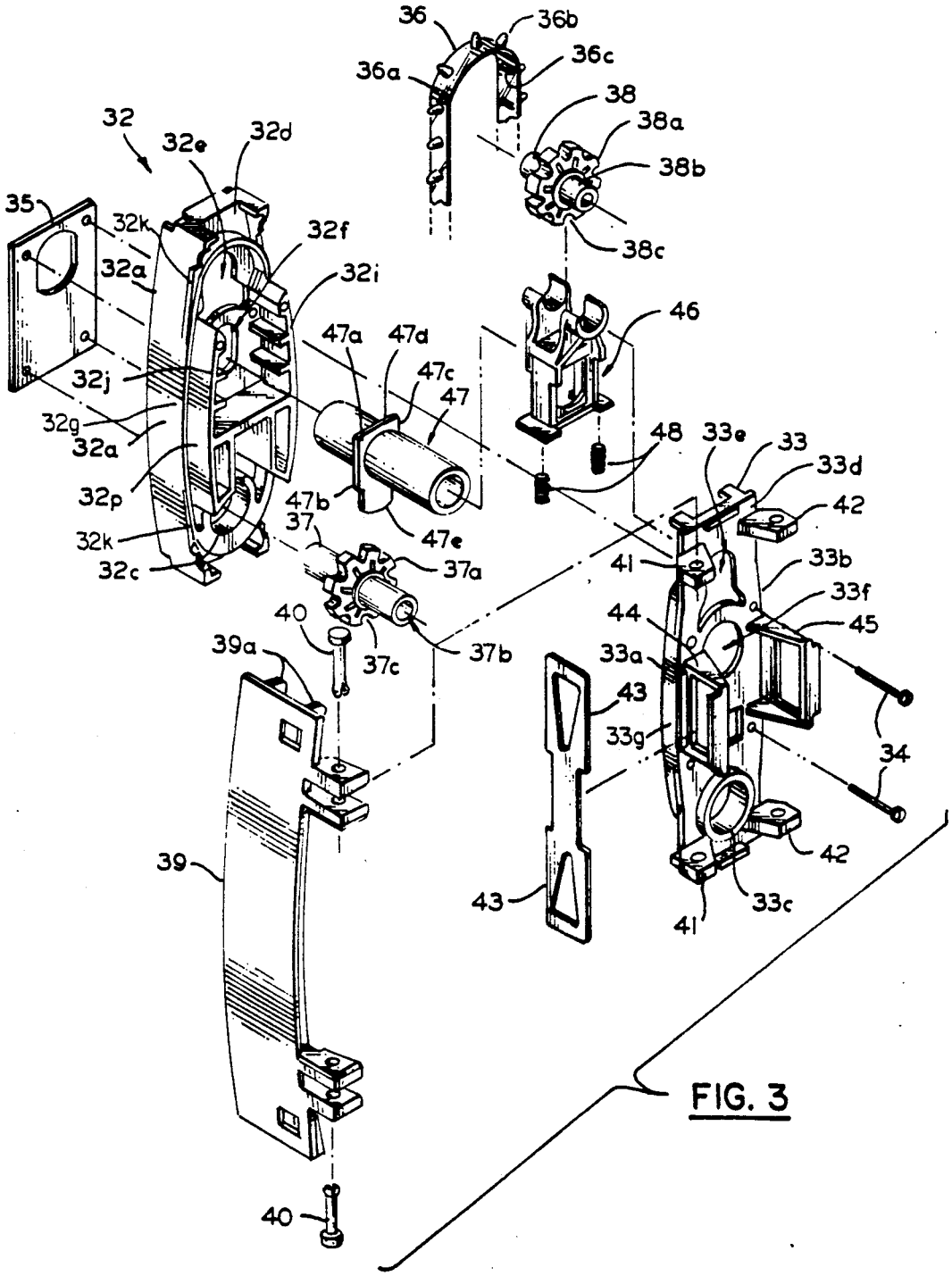
FIG. 3 is an exploded three dimensional view of the tractor assembly of FIG. 2.

FIG. 2 shows a tractor 30 which can be assembled as either the lower right or upper left tractors 10 or 13 in the printer carriage of FIG. 1. As seen in FIGS. 2 and 3, tractor 30 which is mounted on drive shaft 21 and guide shaft 25 has a body or frame 31 comprising a pair of elongate frame members 32 and 33 clamped together by screws 34 and nut plate 35. Located between frame members 32 and 33 is feed belt 36 entrained around spaced sprockets 37 and 38. Sprocket 37 is the drive sprocket and is driven by drive shaft 21. Sprocket 38 is the idler sprocket. The span of belt 36 between the sprockets is sometimes referred to as the trace region. As is conventional, belt 36 has an upper or forward trace region on the top side and a lower or return trace region on the bottom side of tractor 30.

As seen in FIG. 3, feed belt 36 has feed pins 36*b* and gear teeth 36*c*, sometimes called lugs, projecting respectively from the top and bottom sides of a thin endless flexible tension member or web such as band 36*a*. Preferably band 36*a* is made of stainless steel or plastic such as polyimide or polyester. Feed pins 36*b* and gear teeth 36*c* are integral elements and are attached by molding through perforations (not shown) formed in the center of the band 36*a*. Feed pins 36*b* may be tapered to facilitate insertion and removal from the feed holes in paper 14. Gear teeth 36*c* are shaped to mesh within notches in the sprockets 37 and 38. In a preferred form in which the invention is practiced, gear teeth 36*c* are wedge shaped. The width of gear teeth 36*c* is less than the width of band 36*a* so that band 36*a* has overhang regions between its edges and the edges of gear teeth 36*c* whereby belt 36 can be provided with vertical support in the trace regions thereof.

Frame members 32 and 33 have guide surfaces 32*a* and 33*a* respectively on either side of belt 36. Guide surfaces 32*a* and 33*a* are convex and extend the entire length of tractor 30. Guide surfaces 32*a* and 33*a* each have the same convex contour, namely, a slightly curved central region between linear sloped ends. The curved central regions extend roughly the length of the central portion of the trace regions of belt 36. The linear sloped ends of guide surfaces 32*a* and 33*a* extend from the point of juncture with the central section to the ends of the frame members 32 and 33 respectively. Paper 14 is retained on feed pins 36*b* and in engagement with the top of band 36*a* over at least a portion of the trace region of belt 36 and on the guide surfaces 32*a* and 33*a* throughout their length by door 39 which is concave and has ridges 39*a* on its inner side. Ridges 39*a*, which coact with guide surfaces 32*a* and 33*a* to form a paper gap, have a concave contour which essentially parallels the guide surfaces 32*a* and 33*a*. Frame members 32 and 33 have identical convex guide surfaces 32*b* and 33*b* on either side of the return portion of belt 36. Door 39 is rotatably hinged by pins 40 either to flange elements 41 or alternately with flanges 42 on frame member 33. A flat spring 43 supported as a simple beam by either of the platforms 44 or 45 operates to maintain door 39 closed when paper 14 is being fed or in at least one open position when paper 14 is being inserted or removed from tractor 30 as described in copending application Ser. No. 150,348 filed Jan. 29, 1988.

Figure 4:
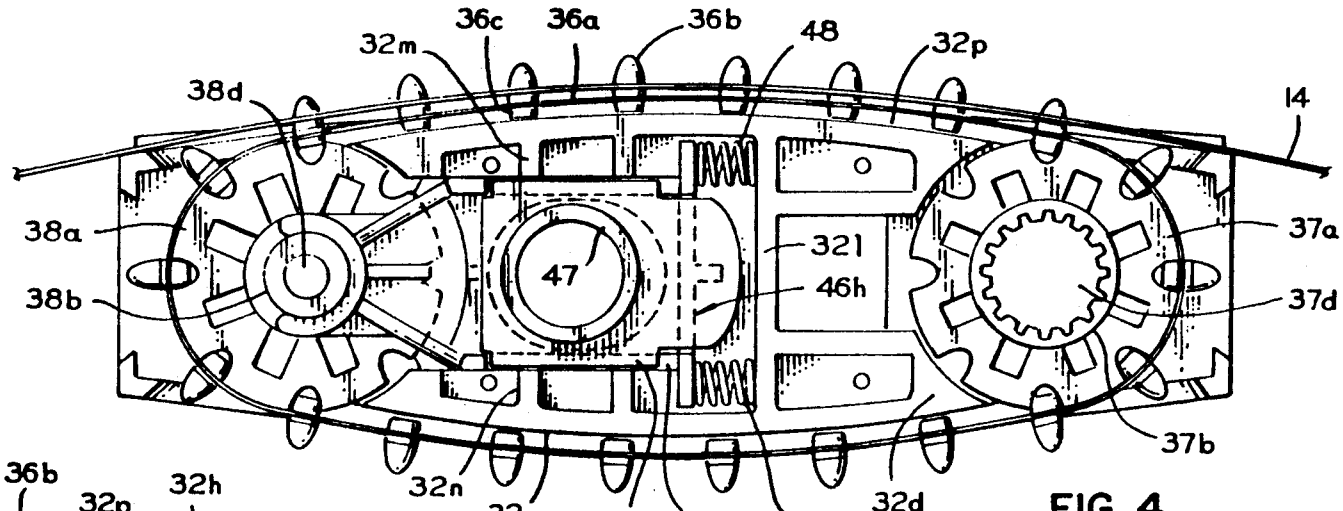
FIG. 4 is a section view of the tractor assembly of FIG. 2 taken along line 4—4.
Figure 6:
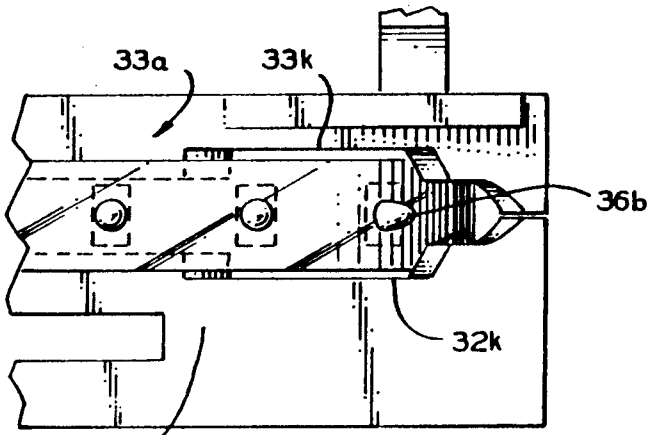
FIG. 6 is an enlarged view of a portion of one end of the assembly of FIG. 2 showing details of the paper separation structure of the guide frames.
Figure 5:
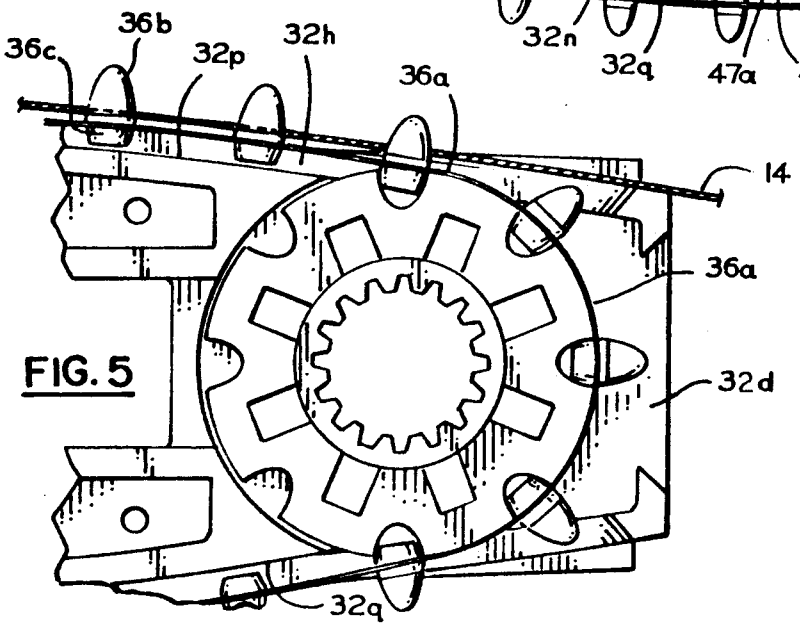
FIG. 5 is an enlarged fragment of the section view of FIG. 4.
Figure 7:
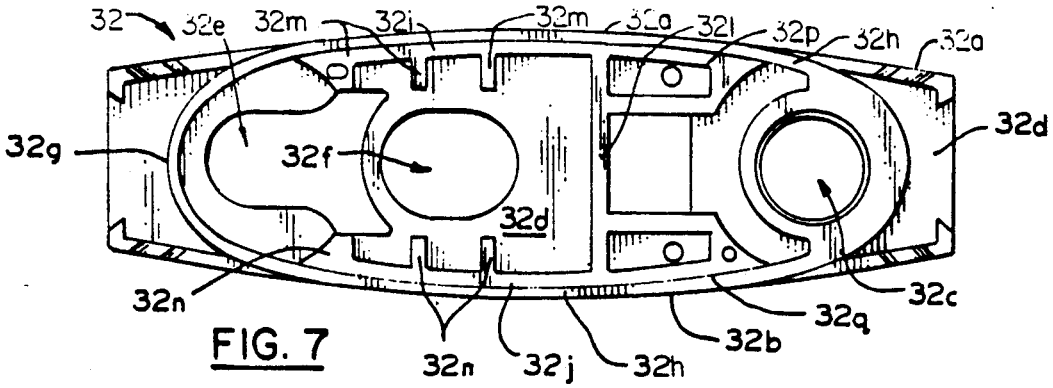
FIG. 7 is a plan view showing details of the interior of one of the frame members shown in FIG. 3.

As shown in FIGS. 3 and 4, drive sprocket 37 comprises wheel 37*a* and hub 37*b*. Wheel 37*a* has V-shaped notches 37*c* which mesh with the wedge shaped gear teeth 36*c* on belt 36. Hub 37*b* has a splined passageway 37*d* for engagement with drive shaft 21. Idler sprocket 38 has wheel 38*a* and hub 38*b*. V-notches 38*c* in wheel 38*a* mesh with gear teeth 36*c* of belt 36. Hub 38*b* may be solid or may have a cylindrical passageway 38*d* for receiving a pin support shaft 38*e* in the alternate embodiment shown in FIG. 10. Both sprockets are preferably molded from plastic. Both wheels 37*a* and 38*a* are the same width and are narrower than gear teeth 36*c*.

Hub 37*b* of sprocket 37 is journaled in cylindrical bearings 32*c* and 33*c* formed respectively in the planar sidewalls 32*d* and 33*d* of frame members 32 and 33. Near the other ends, sidewalls 32*d* and 33*d* have aligned fan-shaped clearance openings 32*e* and 33*e*. Between their ends, sidewalls 32*d* and 33*d* have aligned elongate openings 32*f* and 33*f* which provide a passageway for guide shaft 25. Frame members 32 and 33 are plastic molded parts in which the guide surfaces, the bearings as well as other openings plus other features are formed in one operation.

Figure 9:
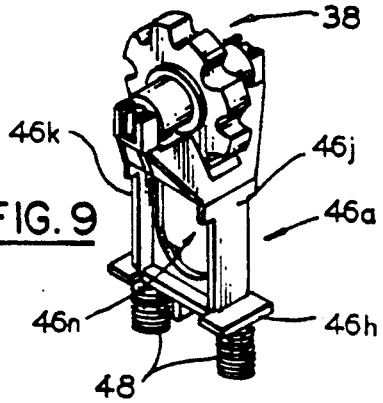
FIG. 9 is a three dimensional view showing the assembly of the tensioning elements of FIG. 10.
Figure 8:
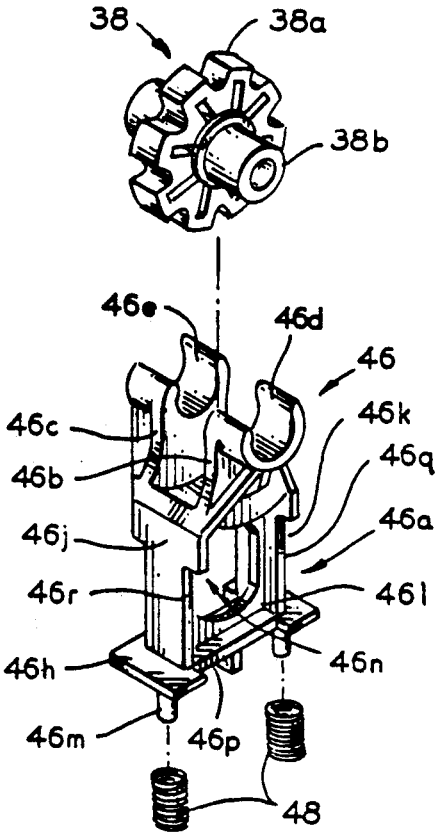
FIG. 8 is an exploded three dimensional view of the belt tensioning elements of the tractor of FIG. 2.
Figure 10:
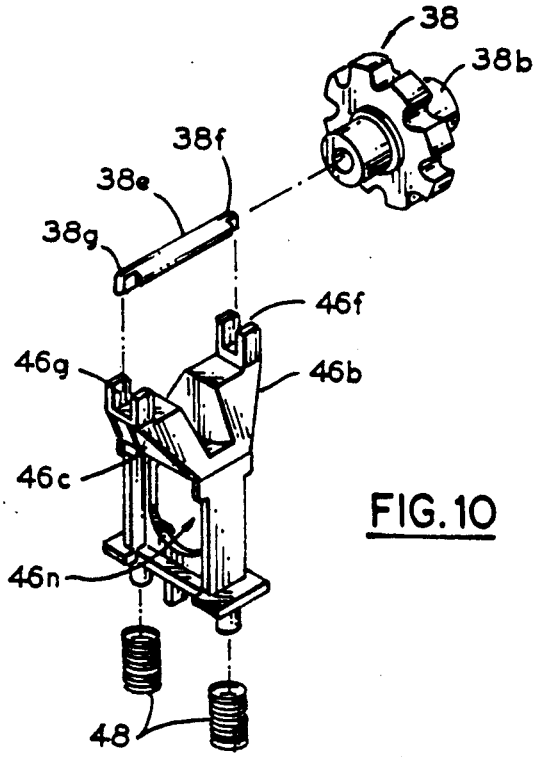
FIG. 10 is an exploded three dimensional view of another embodiment of the elements for tensioning the pin belt of the tractor of FIG. 2.

For the purpose of applying tension to belt 36, idler sprocket 38 is rotatably supported on a carrier 46 which is slidably supported between frame members 32 and 33 for movement relative to drive sprocket 37. As seen in FIG. 8, carrier 46 comprises a rectangular frame 46*a*. Laterally spaced sprocket support arms 46*b* and 46*c* project from one end of carrier frame 46*a*. On the ends of support arms 46*b* and 46*c* are C-bearings 46*d* and 46*e* in which hub 38*b* of sprocket 38 can be snap fitted so as to be journaled therein. In the embodiment of FIGS. 9 and 10, support arms 46*b* and 46*c* have rectangular slots 46*f* and 46*g* which receive the flattened ends 38*f* and 38*g* of pin support shaft 38*e* so as to hold it stationary. In this arrangement, pin shaft 38*e* is stationary and sprocket 38 rotates thereon. This arrangement reduces the susceptibility of the sprocket 38 to becoming clogged and wearing due to paper dust compared to the C-bearing arrangement.

Carrier frame 46*a* has end plate 46*h* which is mutually perpendicular with side plates 46*j* and 46*k* buttressed by a center plate or web 46*l*. Tensioning force for moving frame 46 is supplied by compressed coil springs 48 acting on end plate 46*h*. Retention pins 46*m* projecting from end plate 46*h* maintain the coil springs in position. End plate 46*h* and side plates 46*j* and 46*k* are made slightly wider than the spacing between the sidewalls 32*d* and 33*d* of the assembled frame members 32 and 33 so that carrier 46 can be clamped by the frame members. A guide hole 46*n* through web 46*l* forms a passageway for guide tube 47 through which guide shaft 25 passes and along which guide tube 47 with tractor 30 is slidable. As seen in the figures, guide hole 46*n* is elongate with straight sides and circular ends and having the same dimensions as and is aligned with elongate openings 32*f* and 33*f* in sidewalls 32*d* and 33*d* of the frame members 32 and 33. The distance between the parallel sides of guide hole 46*n* is only slightly larger than the diameter of guide tube 47 thereby enabling carrier 46 with idler sprocket 38 to move easily but not too loosely as a unit relative to tube 47 and its concentrically housed guide shaft 25. This allows tube 47 to move relative to the tractor 30 to compensate for tolerance variations in the separation between guide shaft 25 and drive shaft 21 without disturbing the alignment of tractor 30 relative to the direction of feeding of paper 14.

Attached to tube 47 is retention plate 47*a*. Plate 47*a* is relatively thin but substantially rigid and is affixed to the perimeter of sleeve 47. When assembled to tractor 30, retention plate 47*a* is located between carrier frame 46*a* and either sidewall 32*d* of frame member 32 or sidewall 33*d* of frame member 33. Retention plate 47*a* is formed with lateral extensions 47*b* and 47*c* and longitudinal extensions 47*d* and 47*e*. These extensions reside in guide notches 46*p*, 46*q* and 46*r* in end plate 46*h* and side plates 46*k* and 46*j* end plate 46*h* of carrier frame 46*a* respectively. Notches 46*p*, 46*q* and 46*r* are wide and deep enough so that retention plate 47*a* is permitted movement lengthwise relative to carrier 46 when tube 47 is caused to be moved lengthwise in elongate openings 32*f*, 33*f*, and 46*n* as a result of tolerance variations in the spacing between drive shaft 21 and guide shaft 25. Retention plate 47*a* serves the further function of maintaining the tractor 30 aligned with the direction of paper feeding during this adjustment of the sleeve 47. Tube 47 and retention plate 47*a* are also molded plastic parts.

Projecting from the inner surfaces of sidewalls 32*d* and 33*d* are ledges. The ledges are defined by horizontal surface 32*g* and vertical end wall 32*h* on frame member 32 and by horizontal surface 33*g* and vertical end wall 33*h* on frame member 33. The ledges are identical, oval shaped and encompass the bearing and clearance openings in the respective sidewalls. At their ends, the ledges function as inner dust barriers for protecting sprockets 37 and 38. Between the sprockets, the ledges provide vertical support and lateral guidance to the trace regions of belt 36. In the trace regions, horizontal surfaces 32*g* and 33*g* are coplanar with the central regions of the guide surfaces 32*a* and 33*a* of frame member 32 and 33 respectively. On either side of the central regions, the horizontal surfaces 32*g* and 33*g* form curved ramps which drop below the linear sloped ends of guide surfaces 32*a* and 33*a*. In the vicinity of the sprockets, horizontal surfaces 32*g* and 33*g* drop below and continue below the periphery of sprocket wheels 37*a* and 38*a* for the entire distance where belt 36 wraps around the sprocket wheels. In like manner the horizontal ledge surfaces are also coplanar with the central regions of guide surfaces 32*b* and 33*b* and form curved ramps below the linear sloped ends thereof on the opposite sides.

The horizontal surfaces 32*g* and 33*g* provide vertical support to the underside of belt 36 only along the borders which overhang the edges of gear teeth 36*c* and the edges of band 36*a*. The vertical end walls 32*h* and 33*h* of the ledges engage the edges of one side of the gear teeth 36*c* and in this way provide lateral guidance to the entire length of belt 36. While the horizontal surfaces 32*g* and 33*g* drop below the periphery of the sprockets, the drop is less than the height of the gear teeth 36*c* of belt 36 thereby assuring that lateral guidance of belt 36 continues as belt 36 leaves one trace region, wraps around the sprockets and returns to the second trace region at the proper entrance angle. The width of horizontal surfaces 32*g* and 33*g* is greater than the width of the overhanging borders of band 36*a* so that the edges of gear teeth 36*c* will always encounter vertical end walls 32*h* or 33*h* of the respective ledges and thereby prevent the edges of band 36*a* from engaging any part of sidewalls 32*k* or 33*k* along the ramps and in the vicinity of the sprockets. Of course the edges of band 36*a* make no engagement along the central region of the guide surfaces 32*a*, 33*a*, 32*b* and 33*b* where horizontal surfaces 32*g* and 33*g* are coplanar therewith.

Figure 11:
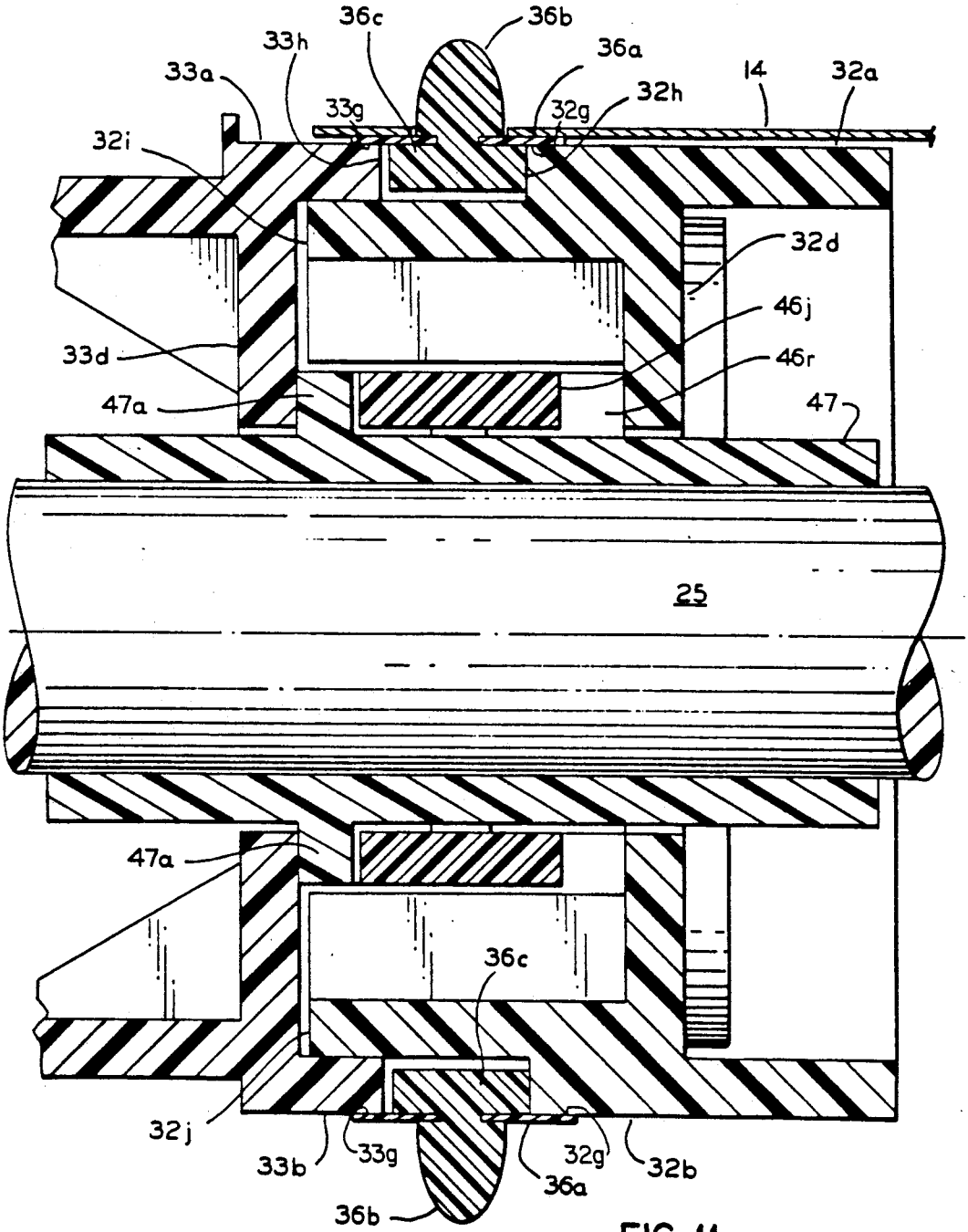
FIG. 11 is an enlarged section view of the tractor assembly of FIG. 2 taken along section lines 11—11.
Figures 12, 13:
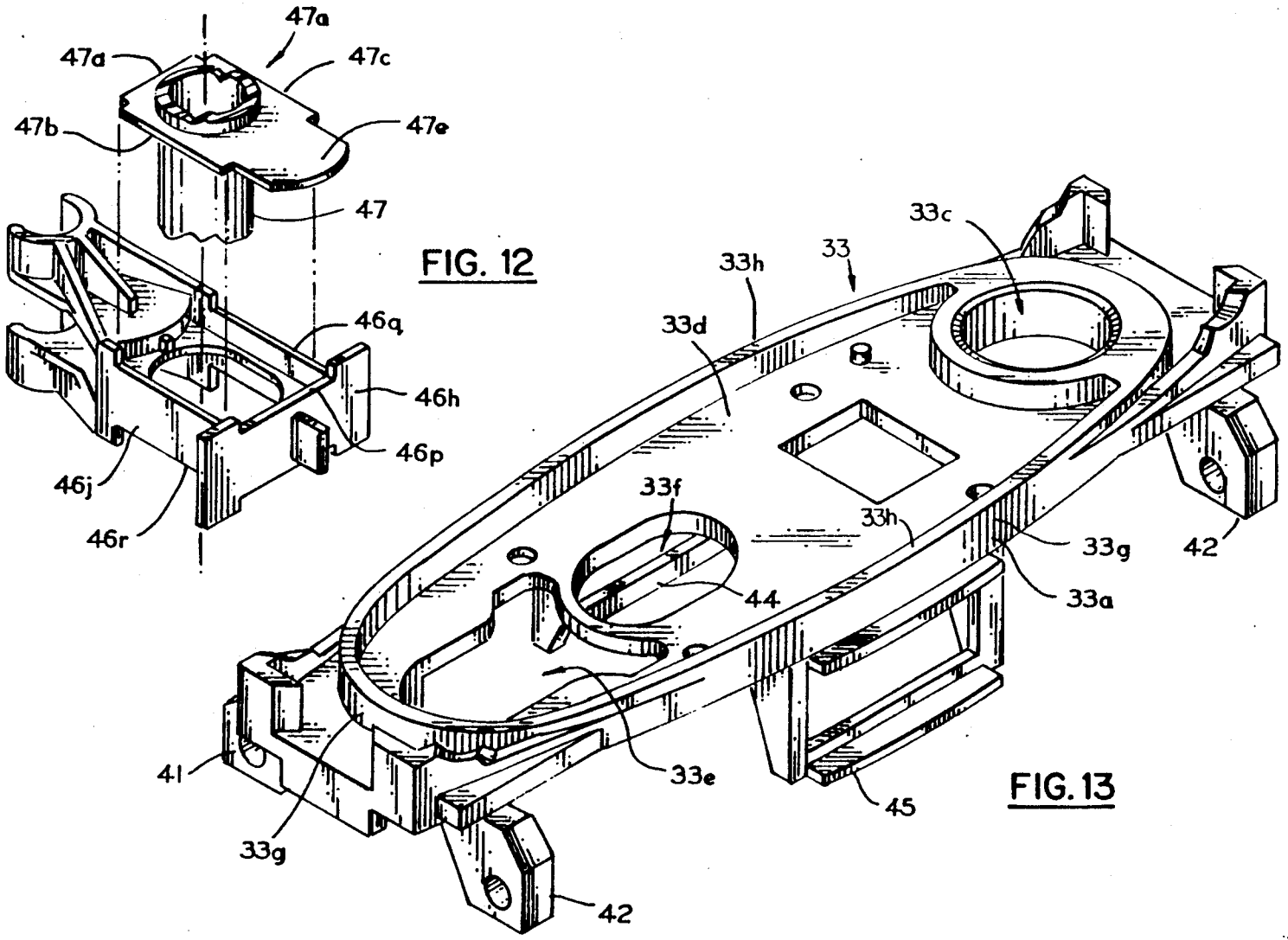
FIG. 12 is an exploded three dimensional view of carrier frame element of FIGS. 8 and 9 showing details of the carrier and the guide tube portions of the paper feed carriage mechanism of FIG. 1.
FIG. 13 is a three dimensional view showing the interior of the second frame member of the tractor assembly of FIGS. 2 and 3.
Figure 14:
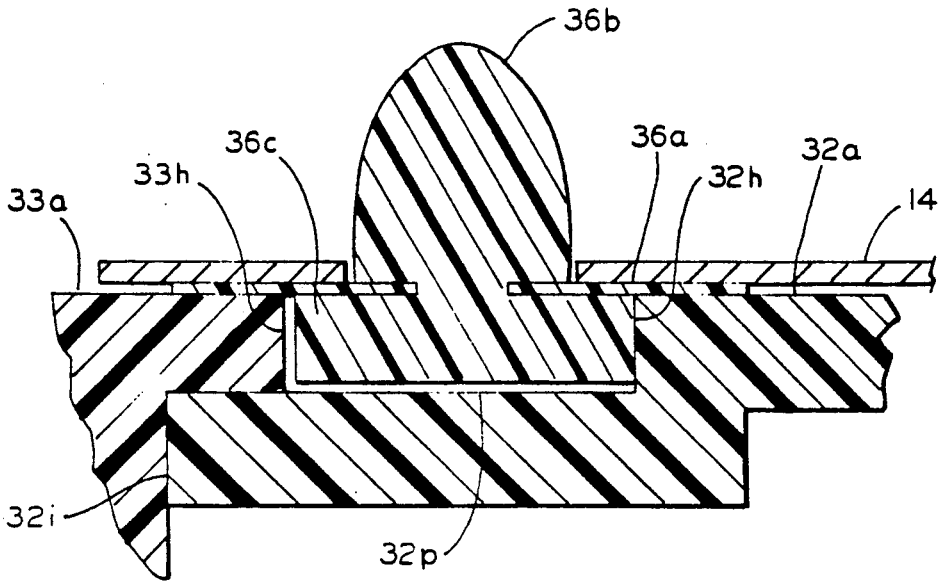
FIG. 14 is a fragment of a section view of the tractor in FIG. 2 taken along lines 14—14 in FIG. 2.
Figure 15:
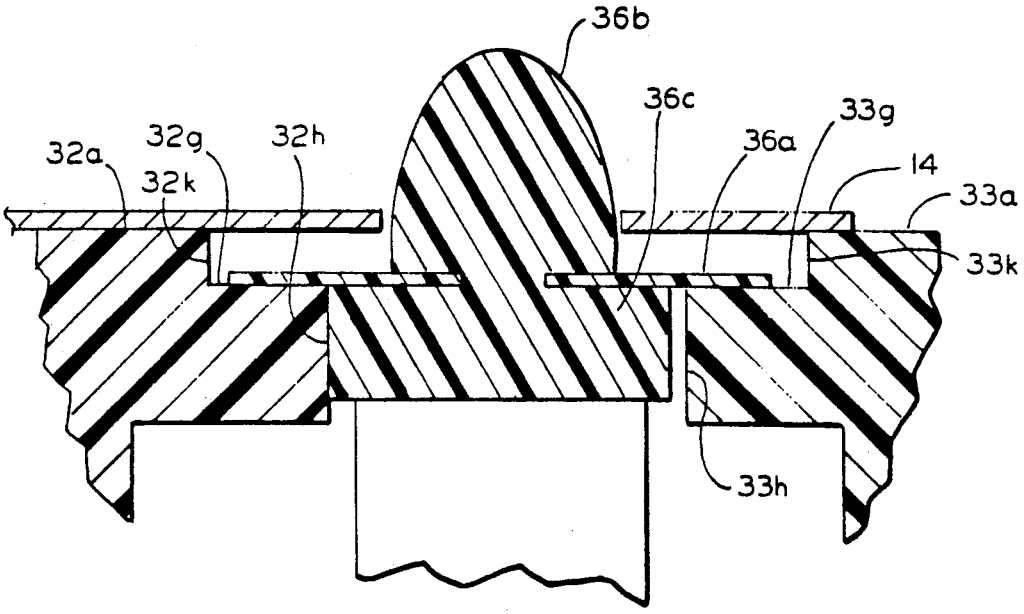
FIG. 15 is another fragment of a section view taken along lines 15—15 in FIG. 2.

In accordance with this invention, the distance between end walls 32*h* and 33*h* is greater than the transverse width of gear teeth 36*c*. Thus, lateral guidance to belt 36 is achieved by gear teeth 36*c* making contact with either vertical end wall 32*h* or 33*h* but not both at the same time. This is shown most clearly in FIGS. 11, 14 and 15 where one edge of gear tooth 36*c* is shown in contact with end wall 32*h* and there is a clearance between the opposite edge of gear tooth 36*c* and end wall 33*h*. This arrangement can be produced when the tractors on one side are moved along shafts 21 and 25 by cable adjustment while the other tractors are held stationary. Thus by preventing the edges of of belt 36 from engaging any part of the frame members 32 and 33, and limiting lateral guidance of the belt by engagement of the gear teeth with either of the end walls 32*h* and 33*h* but not both, by supporting belt 36 by ledges engaging only the overhangs of the belt and limiting such support to the trace regions of belt 36, the amount of frictional contact between the belt 36 and frame members 32 and 33 is greatly reduced. This in turn reduces friction loading and the wear of belt 36 compared to previous structures thereby allowing smaller drive motors to be used and extending the life of the belt and the frame members.

Projecting from the inside and in the central part of sidewall 32*a* are a pair of spaced guide plates 32*i* and 32*j* connected by vertical cross wall 32*l*. Cross wall 32*l* with guide plates 32*i* and 32*j* form an enclosure in which carrier frame 46*a* is housed and is movable to apply tension to belt 36. Tension force is provided by coil springs 48 being held in a compressed state between cross wall 32*l* and end plate 46*h* of carrier frame 46*a*. Upper ribs 32*m* depending from guide plate 32*i* engage side plate 46*k* of carrier frame 46*a*. Lower ribs 32*n* rising from guide plate 32*j* engage side plate 46*d* of carrier frame 46*a*. Ribs 32*m* and 32*n* provide lengthwise guidance and alignment to carrier frame 46*a* with minimum amount of friction thereby enabling an accurate determination of the force of coil springs 48 on belt 36 and permitting a relatively weak spring force to effectively move carrier 46 in spite of any friction produced by engagement of frame 46*a* with sidewalls 32*d* and 33*d*.

The projecting ends of guide plates 32*i*, 32*j* and cross wall 32*l* abut against sidewall 33*d* of frame member 33 and when assembled with screws 34 tightened into nut plate 35, frame 45*a* is clamped in to maintain tension in belt 36. Carrier arms 46*b* and 46*c* are aligned with and extend laterally so as to be partially within clearance openings 32*e* and 33*e*. Sprocket 38, therefore, is free to rotate either in C-bearings 46*d* and 46*d* or on pin support 38*e*.

Guide plates 32*i* and 32*j* have oppositely facing outer surfaces 32*p* and 32*q*. Surfaces 32*p* and 32*q* are convex and are contoured to be parallel with the central guide sections of the guide surfaces 32*a*, 33*a*, 32*b* and 33*b* of frame members 32 and 33 respectively. The ends of guide plates 32*i* and 32*j* which extend slightly beyond the central guide regions into the linear sloped ends regions of guide surfaces 32*a* and 33*a* are beveled to provide clearance to the bottoms of gear teeth 36*c*. Vertical end walls 32*h* and 33*h* of frame members 32 and 33 form a channel for gear teeth 36*c* of belt 36 with surfaces 32*p* and 32*q* of guide plates 32*i* and 32*j*. However, the height of end walls 32*h* and 33*h* is greater than the height of the gear teeth 36*c* so that gear teeth 36*c* are always clear of engagement with surfaces 32*p* and 32*q*. Thus friction loading of belt 36 is confined to the continuous surface of band 36*a*. By confining the vertical support of belt 36 to the overhang portions of band 36*a*, the loading of belt 36 is constant and is not affected by the intermittent contacts that would be produced by the ends of gear teeth 36*c* coming into contact with surfaces 32*p* and 32*q*.

In accordance with this invention, frames 32, 33, carrier frame 46, sleeve 47 and door 39 are molded from polycarbonate containing at least 15 percent carbon fibers to provide stiffness, electrical conductivity and greater heat conductivity than glass plastics with glass fibers. 15 percent carbon fiber by weight is required to dissipate an electrical charge. Another benefit of the carbon fibers is that they are not abrasive to steel as are glass fibers. This prevents the pressure between steel band 36*a* and walls 32*g* and 33*g* from abrading steel band 36*a*. Band 36*a* is less than 0.002 inches thick to provide allowable bending stresses and has no allowance for wear. Frames 32, 33, and carrier 46 also contain 15 percent PTFE for lubrication of both the belt support surfaces 32*g*, 32*h*, 33*g* and 33*h*; bearing surfaces 32*c*, 33*c*, 46*d* and 46*e* and shaft 38*e*.

Sprockets 37 and 38 are molded from nylon 6/10 containing at least 15 percent carbon fibers and 15 percent PTFE. Tests have shown that the combination of nylon and polycarbonate produces little wear of either member. Nylon 6/10 was selected because it is among the least hydroscopic of the nylons. As in the polycarbonate, the 15 percent carbon fibers provides electrical and thermal conductivity and the 15 percent PTFE provides optimum lubrication. Because the PTFE is a dry lubricant, it will not hold paper dust the way liquid lubricants, such as oil, do so that bearing wear due to abrasion by paper dust is eliminated.

While the novel features of the present invention have been shown and described with reference to preferred embodiments thereof, it will be understood by those skilled in the art, that the foregoing and other changes can be made in the form and details without departing from the spirit and scope of the invention.

What is claimed is:

1. A forms tractor comprising frame members on either side of a lengthwise slot, endless forms feed belt having a tension member and drive lugs which are free to travel in said slot and said tension member extends beyond the ends of said drive lugs to form overhang portions bordering the edges of said tension member, drive means for said endless belt including at least one drive sprocket with an axis perpendicular to said slot that engages the drive lugs of said feed belt, each of said frame members containing a belt support surface adjacent to said slot which is overlapped by said overhang portions of said tension member and a forms support surface adjacent to the belt support surface, said belt support surface being co-planar with the forms support surface of said frame members in the center region of the forms tractor and diverges below said forms support surface as it approaches said drive sprocket and the ends of the tractor, whereby the edges of said tension member are above and free of frictional contact with said forms guide surface in said center region of said tractor said frame members each having a first side wall adjacent said slot and below said belt support surface slidably engageable by the ends of said lugs of said belt, and a second side wall adjacent said slot and above said belt support surface and laterally spaced from said first side wall where the belt support surface diverges below said forms support surface, the lateral spacing between said first and second side walls of each of said frame members being greater than the distance said overhang portions of said tension member extend beyond the ends of said drive lugs, so that the edges of said tension member are prevented from engaging said second wall of said frame embers and said belt is guided laterally solely by the contact of the ends of said drive lugs and said first side wall of one of said frame members adjacent said slot.

2. A forms tractor containing support members as described in claim 1 where said frame members are molded pieces and the belt support surface and the forms support surface are integral features on said frame members.

3. A forms tractor as described in claim 1 where said tension member is a band.

4. A forms tractor as described in claim 1 where said belt support surface on each of said frame members curves around and below the periphery of said drive sprocket whereby said overhang portions of said tension member of said belt are disengaged from said belt support surface where said belt travels around said sprocket.

5. A forms tractor as described in claim 4 where said ends of said lugs on one side of said belt are maintained in continuous engagement with said first side wall adjacent said slot of one of said frame members to provide lateral guidance to said belt as said belt travels in said slot and around said sprocket.

6. A forms tractor as described in claim 5 where said drive sprocket is journaled in bearings in said frame members, and said belt support surface and said first wall comprise a ledge on said frame members on either side of said slot which forms a dust barrier within said slot and around said bearings.

7. A forms tractor as in claim 6 where said tractor further includes a second sprocket rotatably supported and longitudinally movable between said frame members, said frame members have bearings at one end of said tractor for journaling said drive sprocket, said frame members have clearance openings at the other end of said tractor so as to afford clearance for the longitudinal movement of said second sprocket, and said ledge on said frame members on either side of said slot is continuous and encompasses said bearings and said clearance openings so as to form an inner dust barrier protecting said drive and said second sprockets.

8. In a feed mechanism for a printer having an endless belt carrying drive elements engageable with perforations in a record medium, at least one sprocket also engageable with the belt, a frame made of molded plastic having a pair of plates disposed in side-by-side relationship and having holes in which said sprocket is journaled, said plates providing a supporting surface and a channel through said supporting surface along which said record medium and said endless belt are in sliding engagement whereby electrostatic charge is producible on said record medium, said pair of plates and said endless belt, the improvement wherein said molded plates are formed from a material which comprises a polycarbonate having a filler of carbon fibers whereby said electrostatic charge may be discharged from said record medium and said plate of said frame to the base portions of said printer.

9. In a feed mechanism in accordance with claim 8 wherein said carbon fibers comprise at least 15 percent by weight of said material.

10. In a feed mechanisms for a printer in accordance with claim 8 wherein said material further comprises a dry lubricant added to the filler of said polycarbonate.

11. In a feed mechanism for a printer in accordance with claim 10 wherein said dry lubricant comprises polytetraflouroethylene.

12. In a feed mechanism in accordance with claim 11 wherein said polytetraflouroethylene comprises about 15 percent by weight of said material.

13. In a feed mechanism in accordance with claim 8 wherein said sprocket has hubs which are rotatably supported by bearing surfaces in said plates and said sprocket is made of molded plastic and the material used is nylon.

14. In a feed mechanism in accordance with claim 13 wherein said material used for said sprocket is nylon 6/10.

15. In a feed mechanism in accordance with claim 13 wherein said material used for said sprocket further comprises a dry lubricant.

16. In a feed mechanism in accordance with claim 15 wherein said dry lubricant is polytetrafluorethylene.

17. In a feed mechanism in accordance with claim 16 wherein said polytetrafluoroethylene comprises about 15 percent by weight of the material used in said sprocket.

18. In a feed mechanism in accordance with claim 13 wherein said material used in said sprocket further comprises carbon fibers.

19. In a feed mechanism in accordance with claim 18 wherein said carbon fibers comprise at least 15 percent by weight of the material used in said sprocket.

20. In a feed mechanism for a printer in accordance with claim 11 wherein said belt comprises a strip of stainless steel.

21. In a tractor web feeding mechanism having a frame comprising first and second sides, web feeding means on said frame including an endless belt rotatively mounted on said frame between said first and second sides, a belt tensioner movably supported between said first and second sides, spring means biasing said belt tensioner into engagement with said endless belt for applying a predetermined tension thereto, said sides and said tensioner having aligned holes for the passage of a guide shaft therethrough which allows said tractor to move laterally along said shaft, said holes in said sides and said tensioner being elongated to enable said tensioner and said tractor to be moved perpendicularly relative to said sides and to said shaft, and means for clamping said sides to fix said tensioner therebetween, the improvement comprising a tube through said holes in said tensioner and said sides for receiving said shaft, and retention means affixed to and radially extending from said tube, said retention means being positioned between said tensioner and one of said sides whereby said tube is movable with said tractor sides laterally along said shaft.

22. In a tractor web feeding mechanism in accordance with claim 21 in which said retention means comprises a flat plate extending radially from the external surface of and transverse to the axis of said tube, and said tensioner includes guide means formed in the side thereof adjacent said flat plate, said guide means coacting with said flat plate for enabling said tube to be moved in the direction of movability of and independently of said tensioner.

23. In a tractor web feeding mechanism in accordance with claim 22 wherein said flat plate has longitudinal and transverse external extensions, said guide means comprises longitudinal and transverse recesses for receiving said longitudinal and transverse arms of said flat plate, said longitudinal and transverse recesses being enlarged and deeper than the thickness of said plate whereby said tube with said plate is movable lengthwise independently of said tensioner.

24. In a tractor web feeding mechanism in accordance with claim 22 wherein said frame, said tensioner, said tube and said plate attached thereto are molded from polycarbonate material with carbon fiber filler.

25. In a tractor web feeding mechanism in accordance with claim 24 wherein said carbon fiber filler comprises at least 15 percent by weight of said material.

26. In a tractor web feeding mechanism in accordance with claim 25 wherein said material includes polytetrafluouroethylene.

* * * * *